US006241482B1

(12) United States Patent
Iga

(10) Patent No.: US 6,241,482 B1
(45) Date of Patent: Jun. 5, 2001

(54) HYDRAULIC PILOT CIRCUIT

(75) Inventor: Makoto Iga, Tokyo (JP)

(73) Assignee: Shin Caterpillar Mitsubishi, Ltd. (JP)

( * ) Notice: Subject to any disclaimer, the term of this patent is extended or adjusted under 35 U.S.C. 154(b) by 0 days.

(21) Appl. No.: 09/162,445

(22) Filed: Sep. 29, 1998

Related U.S. Application Data

(63) Continuation of application No. PCT/JP98/00310, filed on Jan. 27, 1998.

(30) Foreign Application Priority Data

Feb. 24, 1997 (JP) ..... 9-038769

(51) Int. Cl.[7] ..... F04B 1/26
(52) U.S. Cl. ..... 417/222.1; 417/212; 60/426
(58) Field of Search ..... 417/212, 213, 417/222.1; 60/426, 468

(56) References Cited

U.S. PATENT DOCUMENTS

| | | | | |
|---|---|---|---|---|
| 3,847,061 | * | 11/1974 | Ifield | 91/497 |
| 3,952,509 | | 4/1976 | Coleman . | |
| 4,726,186 | * | 2/1988 | Tatsumi et al. | 60/434 |
| 4,986,071 | * | 1/1991 | Voss et al. | 60/420 |
| 5,048,293 | * | 9/1991 | Aoyagi | 60/420 |
| 5,048,294 | * | 9/1991 | Oshina et al. | 60/648 |
| 5,056,312 | * | 10/1991 | Hirata et al. | 60/426 |

FOREIGN PATENT DOCUMENTS

| | | |
|---|---|---|
| 533958 | 4/1992 | (EP) . |
| 593782 | 4/1993 | (EP) . |
| 50-160671 | 12/1975 | (JP) . |
| 63-186005 | 8/1988 | (JP) . |
| 4-140330 | 5/1992 | (JP) . |

OTHER PUBLICATIONS

Abstract of JP 4–140330.
Abstract of JP 63–186005.

* cited by examiner

*Primary Examiner*—Teresa Walberg
*Assistant Examiner*—Thor Campbell
(74) *Attorney, Agent, or Firm*—Millen, White, Zelano & Branigan, P.C.

(57) ABSTRACT

A hydraulic pilot circuit having a pilot pump which discharges pilot oil, and a plurality of pilot valves which control a plurality of hydraulic directional control valves by supplying the pilot oil with control, wherein heating of hydraulic oil due to retaining pilot pressure oil is reduced, and controllability is not damaged even if the plurality of pilot valves are operated at the same time, because sufficient pilot oil is supplied to the pilot valves.

A variable displacement pump is adopted as the pilot pump. An operation detecting means detects operating condition of the hydraulic pilot valves, a controller computes the necessary discharge of the pilot pump for operating the hydraulic directional control valves from the operating condition, and the pilot pump discharges only the necessary oil flow.

3 Claims, 1 Drawing Sheet

HYDRAULIC PILOT CIRCUIT

This application is a continuation of International Application No. PCT/JP98/00310, filed Jan. 27, 1998.

TECHNICAL FIELD

This invention relates to a hydraulic pilot circuit having a plurality of pilot valves which control a plurality of hydraulic directional control valves by pilot oil.

BACKGROUND ART

A hydraulic excavator having a plurality of hydraulic actuators, for example, comprises a hydraulic cylinder for implements, a hydraulic swing motor for an upper swing body, a hydraulic travel motor for a lower travel body and the like as typical actuators. These hydraulic actuators are made to operate by that discharged oil from an actuator pump driven by an engine is supplied to the hydraulic actuators due to control by the hydraulic directional control valves.

As a typical operating means to control the hydraulic directional control valve, a so-called pilot operation is conducted in which pilot oil is supplied to the end portion of a valve spool of the hydraulic directional control valve by a pilot valve to operate the valve spool. This pilot operation is widely utilized for hydraulic excavators, truck cranes and the like, since pilot operation of the hydraulic directional control valve instead of its manual and direct operation reduces operating effort, and enables remote control of the hydraulic directional control valve. Structure of this hydraulic pilot circuit for hydraulic pilot operation will be described below.

(1) The pilot oil is produced and discharged by an engine driven pilot pump with fixed displacement, for example, a gear pump, other than an actuator pump.

(2) The pressure of the discharged pilot oil is set and remained by a relief valve at the pilot pressure necessary for operating the hydraulic directional control valve and the like.

(3) There are provided a plurality of hydraulic directional control valves corresponding to each of the plurality of hydraulic actuators, and a plurality of pilot valves are provided corresponding to each of the plurality of hydraulic directional control valves. When an attachment and the like having the hydraulic actuators are added, the hydraulic directional control valves and the pilot valves for the added hydraulic actuators are additionally mounted.

(4) Regarding the displacement capacity of the pilot pump, the pilot pump with the possible larger displacement capacity is adopted so that the quantity of the pilot oil which is supplied to the pilot valve does not become insufficient, when the plurality of pilot valves are operated at the same time and/or the pilot valves are operated at various speeds. However, it should be noted that when the pilot valves are additionally mounted and increased in number, it causes insufficiency, and therefore changing to a pump with larger discharge may be necessary.

DISCLOSURE OF THE INVENTION

A conventional hydraulic pilot circuit of the structure described above bears the following problems to be solved.

(1) When a pilot valve is not operated, all pilot oil is returned to a tank via a relief valve. Accordingly, the pilot oil with pressure energy generates heat, and the temperature of hydraulic oil is raised. When the pilot oil flow is increased by changing to a pilot pump with larger displacement capacity in order to increase the number of hydraulic actuators and improve the response of the hydraulic actuators, the heating of the hydraulic oil further increases, and thus an oil cooler for cooling the hydraulic oil is further burdened. Furthermore, fuel consumption by an engine which drives a pilot pump increases.

(2) If a hydraulic directional control valve(s) is(are) added to additionally mount attachment and the like, chances and/or frequency of the operation of the plurality of hydraulic directional control valves at the same time increase, whereby the pilot oil which flows into each of the hydraulic directional control valves from the pilot valves runs short if the conventional pilot pump is used. As a result, operability (response) of the hydraulic directional control valves worsens.

The present invention has been accomplished in the light of the foregoing facts, and its technical object is to provide a hydraulic pilot circuit:

(1) in which the heating of the hydraulic oil is reduced, and (2) in which the pilot oil is supplied to the pilot valves sufficiently so as not to damage the controllability even if the pilot valves are additionally mounted and plurality of them are operated at the same time.

In the present invention, to solve the foregoing technical problems, the hydraulic pilot circuit has the following structures.

(1) A variable displacement pump is adopted as the pilot pump.

(2) Operating condition of the hydraulic pilot valves is detected by an operation detecting means, then from the operating condition, the quantity of the oil to be discharged from the pilot pump which is necessary to operate the hydraulic directional control valves is computed by a controller, and the pilot pump discharges the oil of only the minimum necessary quantity.

That is, according to the present invention, as a hydraulic pilot circuit for solving the foregoing technical problems, there is provided a hydraulic pilot circuit characterized in that it has a pilot pump which discharges pilot oil and a plurality of pilot valves which control a plurality of hydraulic directional control valves by supplying the pilot oil with control, wherein the pilot pump is formed of a variable displacement pump.

In a preferred embodiment, the hydraulic pilot circuit is provided with an operation detecting means which detects the operating condition of each of the plurality of pilot valves, and a controller which computes the necessary pilot oil flow based on a detecting signal from the operation detecting means to output a signal to the variable displacement pump as a capacity directing signal. The operation detecting means preferably detects the operation angle of operation levers of the pilot valves.

In the hydraulic pilot circuit of the present invention, (1) The operating condition of the plurality of pilot valves (number of the operated pilot valves, the extent of opening of the operated pilot valves) is detected by the operation detecting means.

(2) The necessary pilot oil flow is computed by the controller, and the necessary discharge is directed to the variable displacement mechanism of the pilot pump.

(3) The variable displacement mechanism of the pilot pump works, and the directed oil flow is discharged from the pilot pump. Therefore, the minimum necessary pilot oil flow is maintained, thus heating of the hydraulic oil and the increase of the fuel consumption by the engine is controlled, and the operability (response) can be improved.

BEST MODE FOR CARRYING OUT THE INVENTION

Figure 1:
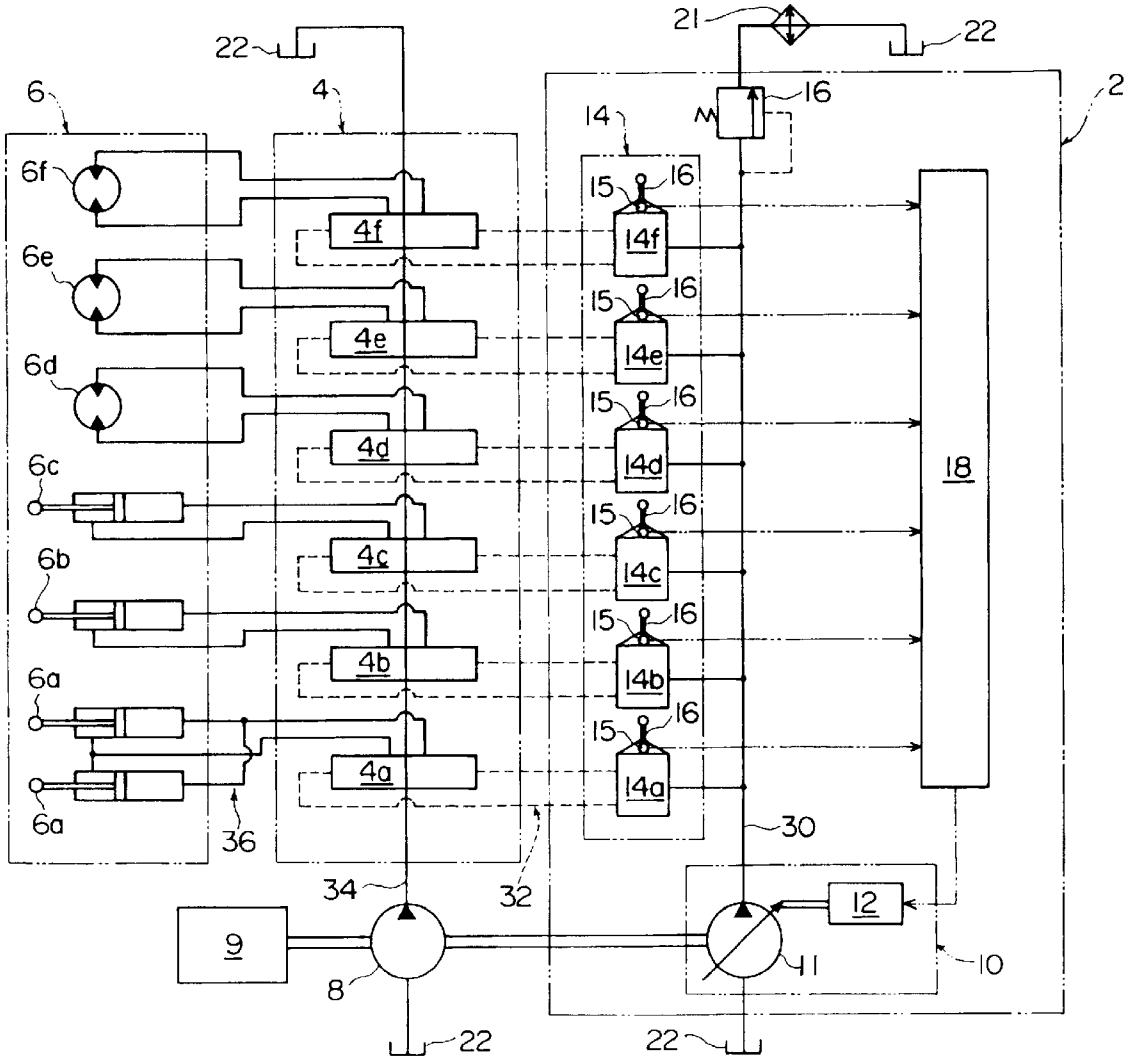
FIG. 1 is a schematic view of the hydraulic actuator operation system of a hydraulic excavator including an embodiment of the hydraulic pilot circuit constructed according to the present invention.

A preferred embodiment of a hydraulic pilot circuit constructed in accordance with the present invention will be described more in detail with reference to the accompanying drawing.

An embodiment of a hydraulic excavator having a plurality of hydraulic actuators will be described with reference to FIG. 1. An operation system of the hydraulic actuators of the hydraulic excavator comprises a hydraulic pilot circuit designated entirely as the numeral 2, a plurality of hydraulic directional control valves 4 operated by the hydraulic pilot circuit 2, a plurality of hydraulic actuators 6 operated by the hydraulic directional control valves 4 and an actuator pump 8 which discharges hydraulic oil for driving the hydraulic actuators 6.

The hydraulic pilot circuit 2 comprises a variable displacement pilot pump 10 which is rotationally driven by an engine 9 to discharge the pilot oil and a plurality of pilot valves 14 which supply the pilot oil with control to control the plurality of hydraulic directional control valves 4. The hydraulic pilot circuit 2 further includes a relief valve 20 which regulates the pressure of the pilot circuit and a controller 18 which computes quantity of the oil to be discharged from the pilot pump 10 based on an operating condition of the plurality of pilot valves 14 to direct the pilot pump 10. The discharged oil from the pilot pump 10 is conveyed to the relief valve 20 via an oil line 30, then returned to a tank 22 through the relief valve 20. Accordingly, constant pilot pressure is retained in the oil line 30. The oil line 30 is connected to each of the plurality of pilot valves 14. Also, an oil cooler 21 is mounted between the relief valve 20 and the tank 22 for cooling the hydraulic oil.

The plurality of hydraulic actuators 6 include a pair of boom cylinders 6*a*, 6*a*, an arm cylinder 6*b*, a bucket cylinder 6*c*, which are hydraulic cylinders of implements, a swing motor 6*d* of an upper swing body and a pair of right and left travel motors 6*e*, 6*f* of a lower travel body. Each of the plurality of hydraulic actuators 6 is connected to the corresponding hydraulic directional control valve among the plurality of hydraulic directional control valves 4 by oil lines 36. The plurality of hydraulic directional control valves 4 include a hydraulic directional control valve 4*a* for the boom cylinders, a hydraulic directional control valve 4*b* for the arm cylinder, a hydraulic directional control valve 4*c* for the bucket cylinder, a hydraulic directional control valve 4*d* for the swing motor and hydraulic directional control valves 4*e*, 4*f* for the pair of travel motors. To each of the plurality of hydraulic directional control valves 4, the discharged oil from the actuator pump 8 is supplied, and in a neutral condition where the hydraulic directional control valves 4 are not operated, the discharged oil flows into the tank 22. Each of the plurality of hydraulic directional control valves 4, that is, the hydraulic directional control valve 4*a*, 4*b*, 4*c*, 4*d*, 4*e*, 4*f* itself comprises a three position spool valve of pilot operation, and is usually retained at a center valve position where the discharged oil from the actuator pump 8 is not flowed into the hydraulic actuators 6. When the pilot oil from the pilot valves 14 is selectively supplied into either one of both end portions of a valve spool via an oil line 32, the hydraulic directional control valves 4 are selectively operated so that the hydraulic oil is supplied to the hydraulic actuators 6.

The plurality of pilot valves 14 include a pilot valve 14*a* for a boom which operates the hydraulic directional control valve 4*a* for the boom cylinder, a pilot valve 14*b* for an arm which operates the hydraulic directional control valve 4*b* for the arm cylinder, a pilot valve 14*c* for a bucket which operates the hydraulic directional control valve 4*c* for the bucket cylinder, a pilot valve 14*d* for swing which operates the hydraulic directional control valve 4*d* for the swing motor and pilot valves 14*e*, 14*f* for travel which respectively operate the hydraulic directional control valves 4*e*, 4*f* for the travel motor. Each of the plurality of pilot valves 14, that is, the pilot valve 14*a*, 14*b*, 14*c*, 14*d*, 14*e*, 14*f* itself comprises a conventional three position spool valve, and is operated by selectively swinging the operation levers 16, which operate the valve spools, in a predetermined direction around its center of rotation. When the operation levers 16 are not operated, the pilot valves 14 are retained at the center valve position where the pilot oil is not flowed into the hydraulic directional control valves 4 from the pilot pump 10. By operating the operation levers 16, the pilot oil is selectively supplied via the oil lines 32 to either one of the both end portions of the valve spools of the corresponding hydraulic directional control valves among the plurality of hydraulic directional control valves 4. An operation detecting means 15 comprises a conventional potentiometer which detects displacement of a rotational angle. The operation detecting means 15 is mounted on the rotational center of the operation levers 16, and is so constructed as to electrically detect angular displacement of the operation levers 16 from their center valve position. The detected angular displacement signal is output to the controller 18. That is, in a state where the pilot valves 14 are not operated, the angular displacement of the operation levers 16 from their center valve position is 0, and when they are operated, the extent of operation (extent of opening of the valves) is detected as angular displacement.

The pilot pump 10, which is a variable displacement pump, has, for example, a conventional swash plate type piston pump 11 of which discharge is altered by changing the angle of the swash plate, and a swash plate regulator 12 which controls the angle of the swash plate. The swash plate regulator 12 includes a control cylinder (not shown) which alters the angle of the swash plate, and a solenoid controlled hydraulic valve (not shown) which controls actuation of the control cylinder. When the solenoid controlled hydraulic valve is operated by an electric signal, the control cylinder operates to change the inclination of the swash plate, and then the piston stroke of the piston pump 11 is altered to change its discharge. It is preferred that the maximum displacement capacity of the pilot pump 10 is set slightly larger than the maximum displacement capacity of a conventional pilot pump with a fixed displacement capacity.

Based on the detected signal from the operation detecting means 15, the controller 18 comprising a micro computer computes the necessary discharge of the pilot pump 10 from the number of pilot valves which are operated among the plurality of pilot valves 14, and the extent of opening of the pilot valves, then it outputs a capacity directing signal to the swash plate regulator 12.

Action of the hydraulic pilot circuit 2 constructed as mentioned above will be described.

(1) The pilot oil discharged from the pilot pump 11 flows into the oil line 30, and in the neutral condition where the plurality of pilot valves 14 (14*a*, 14*b*, 14*c*, 14*d*, 14*e*, 14*f*) are not operated, the pilot oil is discharged into the tank 22 through the relief valve 20 and the oil cooler 21 with retaining the pilot pressure in the oil line 30.

(2) When any of the operation levers 16 of the pilot valves among the plurality of pilot valves 14 is operated, the operating condition of the operation levers 16 (the number of the pilot valves under operation, the extent of opening of the pilot valves) is detected by the operation detecting means 15, and is output to the controller 18.

(3) The controller 18 computes the necessary discharge of the pilot pump 10 based on the output signal from the operation detecting means 15, and outputs the capacity directing signal to the swash plate regulator 12. That is, in a state where one of the plurality of pilot valves 14 is operated, the capacity directing signal is so output that the pi lot oil flow equals the total discharge of the oil flow necessary for a single pilot valve and the minimum necessary oil flow for maintaining the pilot pressure. Similarly, in a state where a plurality of pilot valves among the plurality of pilot valves 14 are operated at the same time, the capacity directing signal is so output that the pilot oil flow equals the total discharge of the oil flow necessary for the plurality of pilot valves and the minimum necessary oil flow for maintaining the pilot pressure. Also, in either of the operating conditions, according to the extent of opening of the pilot valves, the capacity directing signal is so compensated that the quantity of the discharged oil is in proportion to the extent of opening. Further, in a state where all the plurality of pilot valves 14 are at the center valve position and they are not operated, the capacity directing signal is so output that the discharge of the pilot pump 10 is the minimum necessary discharge for the standby condition where the pilot pressure for operating the pilot valves 14 is retained.

(4) As for the pilot pump 10, the solenoid controlled hydraulic valve of the swash plate regulator 12 is operated according to the capacity directing signal output from the controller 18, whereby the control cylinder is actuated to change the inclination of the swash plate. As a result, the discharge of the pilot pump 10 is changed.

(5) The pilot oil from the operated pilot valves 14 passes through the oil lines 32, flows into the selected end portion of the valve spools of the corresponding hydraulic directional control valves 4 to control the hydraulic directional control valves 4. The discharged oil from the actuator pump 8 driven by the engine 9 flows from the oil line 34 to the oil lines 36, and then flows into the corresponding hydraulic actuators among the plurality of hydraulic actuators 6 to make the hydraulic actuators operate.

(6) When the operation levers 16 of the pilot valves 14 are returned to the center valve position, the flow of the pilot oil which passes through the oil lines 32 to the hydraulic directional control valves 4 halts. As a result, the hydraulic directional control valves 4 which have been operated returns to the neutral condition, and the hydraulic actuators 6 which have been in operation halt. Unless there are other pilot valves 4 which have been operated, as stated previously, the discharge of the pilot pump 10 is set to the minimum necessary discharge for the standby condition where the pilot pressure for operating the pilot valves 14 is retained.

The hydraulic pilot circuit constructed as described above have the following effects.

(1) In the neutral condition where the pilot valves are not operated, the quantity of the discharged oil from the pilot pump is regulated to the minimum to minimize the oil flow which passes through the relief valve, and hence the heating of the hydraulic oil is reduced. The increase of the fuel consumption by the engine which drives the pilot pump is controlled, and the burden for cooling the hydraulic oil by the oil cooler is reduced.

(2) From the pilot pump, the minimum necessary pilot oil flow according to the number of the pilot valves that are operated at the same time, and the extent of opening of the pilot valves is discharged. Therefore, even if the pilot valves are increased, operation disadvantage of the hydraulic directional control valves due to insufficiency of the pilot oil is prevented, and the controllability (response) is not damaged.

While the present invention has been described in detail with reference to the embodiments, the present invention is in no way limited thereto, but various changes and modifications may be made within the spirit and scope of the invention. For example, (1) In the embodiment, as an operation detecting means for detecting the operating condition of the pilot valves, the operation angle of the operation levers of the pilot valves is detected. However, when the pilot valves are solenoid controlled valves, it is possible to detect the operating condition of the pilot valves by detecting the output of electric switches which operate the solenoid controlled valves. Also, if the pilot valves are electric proportional direction control valves, it is possible to directly sense a controlling electric signal to detect the operating condition of the pilot valves.

(2) In the embodiment, the hydraulic directional control valves which control the hydraulic actuators are controlled by the pilot valves of the hydraulic pilot circuit. However, there is no need to dwell upon that the hydraulic directional control valves controlled by the pilot valves are in no way limited to the hydraulic directional control valves which operate the hydraulic actuators, but can be applied to a pressure control valve, a flow control valve, a logic valve, a check valve and other directional control valves which are controlled by the pilot oil.

According to the hydraulic pilot circuit constructed in accordance with the present invention, there is provided a hydraulic pilot circuit (1) which reduces heating of hydraulic oil, and (2) which does not damage controllability even if pilot valves are increased and a plurality of them are operated at the same time.

What is claimed is:

1. A hydraulic pilot circuit having a pilot pump which discharges pilot oil, and a plurality of pilot valves which control a plurality of hydraulic directional control valves by supplying the pilot oil with control; wherein the pilot pump is a variable displacement pump.

2. The hydraulic pilot circuit of claim 1, wherein the hydraulic pilot circuit is provided with an operation detecting means which detects operating condition of each of the plurality of pilot valves, and a controller which computes necessary pilot oil flow based on the detected signal from the operation detecting means to output it to the variable displacement pump as a capacity directing signal.

3. The hydraulic pilot circuit of claim 2, wherein the operation detecting means detects an operation angle of operation levers of the pilot valves.

* * * * *